US008157330B2

(12) United States Patent
Niederriter

(10) Patent No.: US 8,157,330 B2
(45) Date of Patent: Apr. 17, 2012

(54) METHOD AND APPARATUS FOR MAINTAINING LONGWALL FACE ALIGNMENT

(75) Inventor: Edward F. Niederriter, Fryburg, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 363 days.

(21) Appl. No.: 12/433,311

(22) Filed: Apr. 30, 2009

(65) Prior Publication Data

US 2010/0276982 A1 Nov. 4, 2010

(51) Int. Cl.
*E21C 35/24* (2006.01)

(52) U.S. Cl. ..... 299/1.6

(58) Field of Classification Search ..... 299/1.6, 299/1.05, 1.3, 1.4; 405/272, 288, 302; 404/84.1, 404/118; 356/152, 153, 172
See application file for complete search history.

(56) References Cited

U.S. PATENT DOCUMENTS 3,603,688 A * 9/1971 Smith-Vaniz ..... 356/400
4,272,129 A 6/1981 Pearey
4,351,565 A * 9/1982 Takahashi et al. ..... 299/1.6
4,355,895 A 10/1982 Cairns et al.
4,372,618 A 2/1983 Pearey
4,466,667 A * 8/1984 Poulsen et al. ..... 299/1.6
5,553,925 A 9/1996 Merten et al.
2007/0140792 A1 * 6/2007 Quenzi et al. ..... 404/84.1

* cited by examiner

*Primary Examiner* — John Kreck
(74) *Attorney, Agent, or Firm* — Michael Best & Friedrich LLP

(57) ABSTRACT

A mining machine includes a light source and a roof support guide for detecting the relative angular alignment between the mining machine and the roof support. The light source in the form of a laser on the mining machine, directed toward the roof support. The roof support guide is on the roof support above the mining machine, so that when the alignment between the mining machine and the roof support is as desired, light from the light source falls in a predetermined location relative to the roof support guide. When the mining machine is not in proper alignment with the roof support, the light source does not fall within the predetermined location relative to the roof support guide. When a mining machine operator detects that the light from the light source is not falling within the predetermined location relative to the roof support guide, the operator then adjusts the tilt of the mining machine using hydraulic jacks to cause the light from the light source to again fall within the predetermined location relative to the roof support guide.

15 Claims, 3 Drawing Sheets

METHOD AND APPARATUS FOR MAINTAINING LONGWALL FACE ALIGNMENT

BACKGROUND

The present disclosure relates to a mining machine and method whereby a mining machine can be operated to move across a seam containing minerals to be mined. The disclosure has particular, although not exclusive application, in the longwall mining of coal. Still more particularly, this disclosure relates to a mechanism and method to control the functions of a longwall miner in response to observations of the coal panel face alignment.

In the mining of coal, processes have been developed which are referred to as longwall mining processes. In these processes a movable rail is placed to span across a coal seam. A mining machine is provided with a shearing head or a plough and the mining machine is moved to traverse along the rail in one direction along the seam, and the shearing head or plough is manipulated upwardly and downwardly to shear coal from the face of the seam. Throughout each pass, the rail is moved forwardly toward the seam behind the path of the mining machine. The mining machine is then caused to traverse the seam in the opposite direction whilst the shearing head is manipulated upwardly and downwardly to remove further coal from the seam. The process is repeated until all coal in the planned extraction panel is completed. In order to protect the mining machine from falling material, a powered roof support is provided above the rail and the mining machine, and moves with the rail.

Coal is transferred from the seam by an armored face conveyor. Each section of the face conveyor is connected to the powered roof support by a double-acting hydraulic cylinder or ram. After the coal in front of a given face conveyor section is mined, its corresponding roof support is lowered and advanced and then hydraulically "set" against the roof, with the face conveyor section then being advanced. U.S. Pat. No. 4,228,508 illustrates such a longwall mining system. Thus, by advancing the rail means forwardly towards the seam by a suitable distance after each pass, it is possible to progressively move into the seam with an approximate equal depth of cut with each pass.

Proper maintenance of face alignment of the mining machine to the panel being cut is important in maximizing productivity in longwall coal mining. In other words, and as further illustrated in the drawings, it is important to make sure that the orientation of the shearing machine or plough is parallel to the mineral face being cut. Misalignment to the panel face can require additional cuts to again obtain the desired panel profile resulting in significant loss of productivity. A wide variety of intervening circumstances, such as operator error, buildup of floor debris, uneven floor or roof, and deteriorating performance of miner hydraulic components can cause such a misalignment.

SUMMARY

An object of this disclosure is to maintain proper face alignment of a longwall mining machine as the mining machine advances sequentially through the mineralized ore zone.

In this disclosure, the mining machine includes alignment means for detecting the relative angular alignment between the mining machine and the roof support, which in turn is related to the proper alignment of the mining machine with the panel face. The alignment means comprises a light source in the form of a laser on the mining machine, and directed toward the roof support. The alignment means also includes a roof support guide on the roof support above the mining machine, so that when the alignment between the mining machine and the roof support is as desired, light from the light source falls in a predetermined location relative to the roof support guide. When the mining machine is not in proper alignment with the roof support, the light source will not fall within the predetermined location relative to the roof support guide, as shown in FIG. 3. When a mining machine operator detects that the light from the light source is not falling within the predetermined location relative to the roof support guide, the operator then adjusts the tilt of the mining machine using the hydraulic jacks to cause the light from the light source to again fall within the predetermined location relative to the roof support guide.

Figure 1:
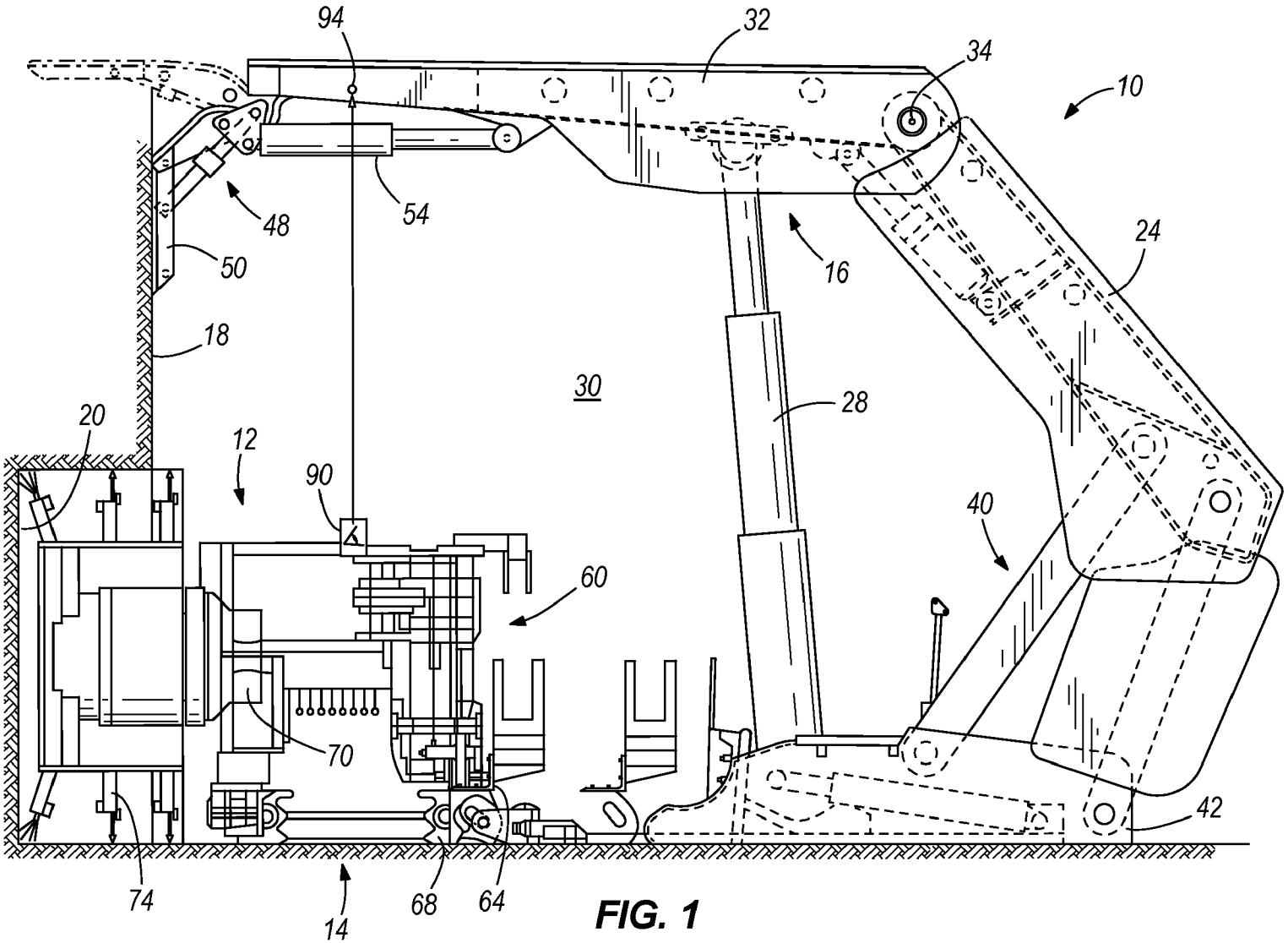
FIG. 1 is a side view of a longwall mining machine advancing through a mineral bed and illustrating the face alignment system.
Figure 4:
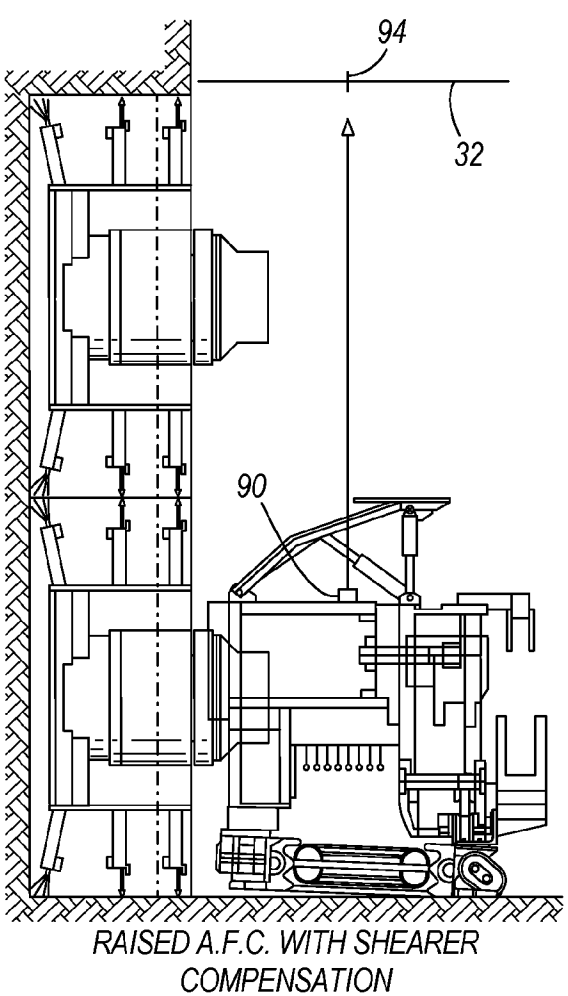
FIG. 4 is a side view of the longwall mining machine of FIG. 1 shown in a position of corrected alignment to the panel face.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

FIG. 1 illustrates a longwall system 10 having a mining machine in the form of a shearer 12 (carried on a face conveyor 14) and cantilevered roof supports 16. As the longwall system 10 advances through the panel 18, the self-advancing roof supports 16 advance toward the face 20 in a well-known manner.

More particularly, the cantilevered roof support 16 is a chock shield support unit having a floor-engaging base 42 and a roof-engaging beam 24 supported by four hydraulically operable supports 28 (only two of which are shown) spaced apart in pairs fore and aft to define an access travelling way 30. A shield 32 is pivotally attached at 34, to the roof beam 24 and is connected by lemniscate linkages 40 to the base 42. The shield 32 also carries at its front end a face sprag assembly 48 including a contact plate 50 that is shown in a face-supporting mode, where the plate 50 is extended from its stowed position by a hydraulic cylinder 54 to a position where it abuts a part of the face. The face sprag assembly's fully extended position is shown in ghost in FIG. 1.

More particularly, the shearer 12 has a mining machine support in the form of an elongated mobile frame 60 with a skid-type shoe 64 that is movably supported on a race 68 that is substantially parallel with the longwall face. A laterally extending rotary drum 70 which has a plurality of mining bits 74 attached thereto is pivotally attached to each end of the elongated mobile frame 60 by a corresponding boom member (not shown). The operation of the shearer 12 is well known in the mining art and, as such, will not be discussed in detail herein. However, the skilled artisan will appreciate that the shearer 12 is moved back and forth on the race 68 such that the mining bits 74 on the rotating drums 70 can be brought into engagement with the mine face to dislodge material there from. As the face recedes, the race 68 and shearer 12 are advanced towards the face to enable the mining process to be continued.

Figure 5:
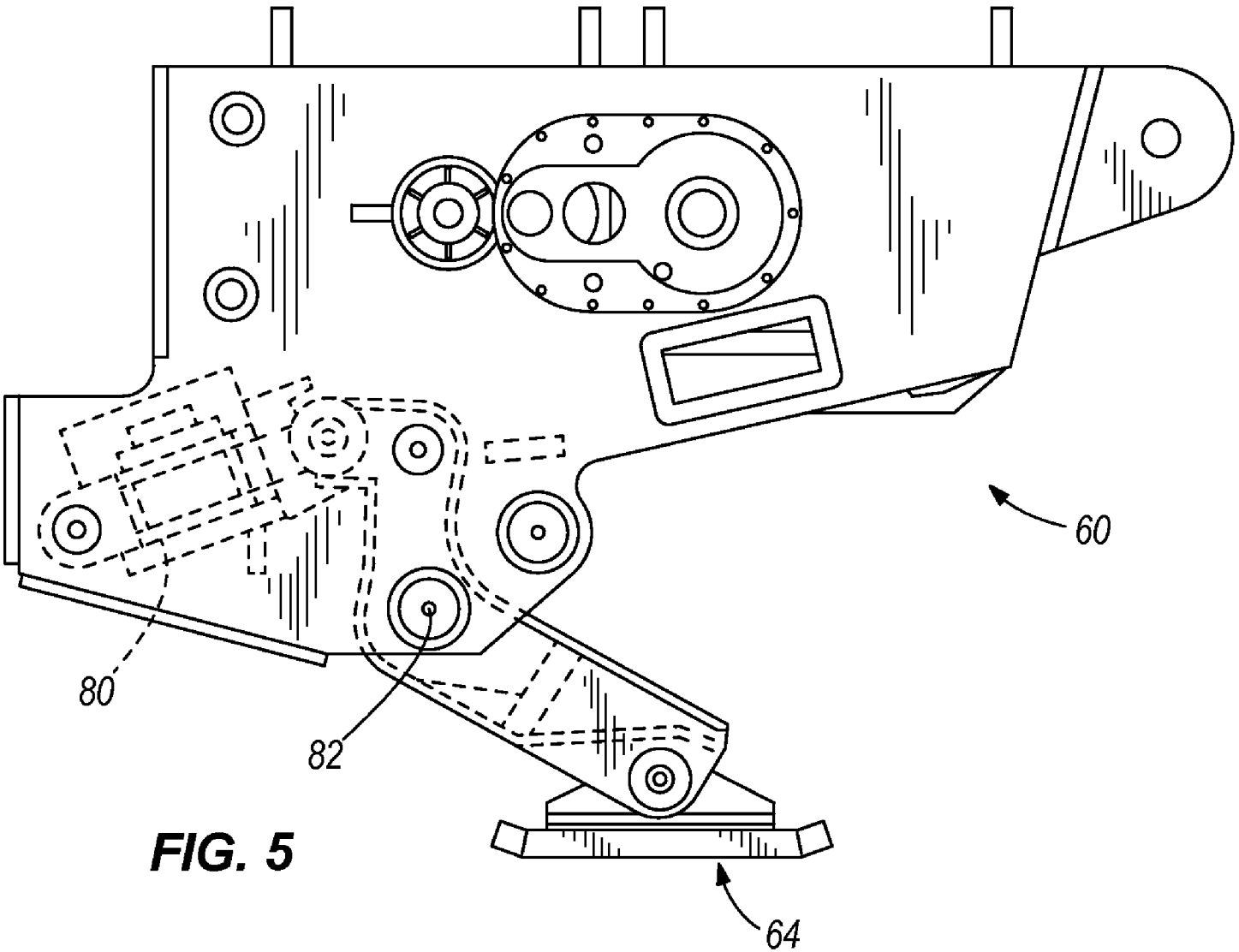
FIG. 5 is a side view of a shoe mounted on the mining machine in order to correct misalignment of the mining machine with the panel face.

As shown in FIG. 5, the skid-type shoe 64 incorporates means for adjusting the angle of attack of the mining machine relative to the mine face in the form of hydraulic jacks 80 for ranging the machine to give a variable pitch and roll facility for horizon control. More particularly, the shoe includes a shoe leg that is L shaped and pivotally attached at 82 near its midpoint to the mobile frame 60. At one end of the shoe leg is the shoe 64. At the other end of the shoe leg is the hydraulic jack 80 connected at one end to the mobile frame 60, and at the other end to the shoe leg. Extension and retract of the hydraulic jack 80 causes the mobile frame 60 to raise or lower relative to the shoe 64.

Figure 3:
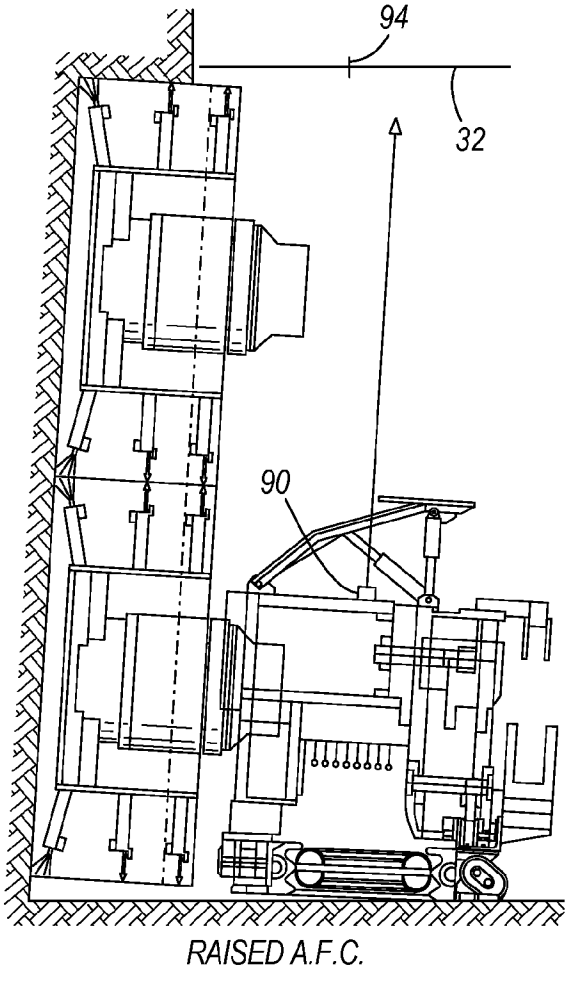
FIG. 3 is a side view of the longwall mining machine of FIG. 1 shown in a position of improper alignment to the panel face.
Figure 2:
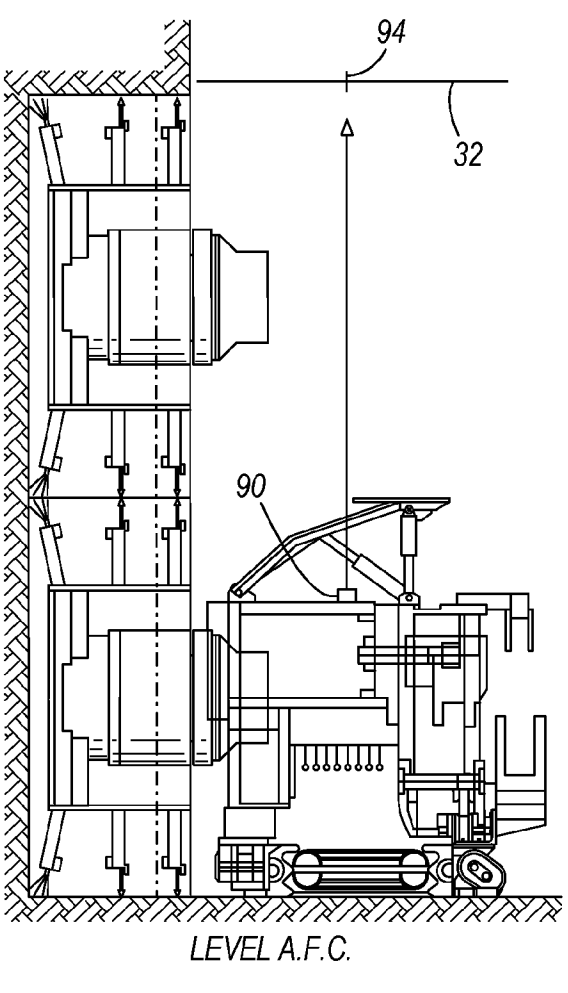
FIG. 2 is a side view of the longwall mining machine of FIG. 1 shown in a position of proper alignment to the panel face.

This adjustable shoe 64 is on the rear of the mobile frame 60, away from the panel face 20. When the mobile frame 60 is raised or lower the relative to the shoe 64, this adjusts the orientation of the mining machine 12 to the panel face 20. More particularly, as shown in FIG. 2, the mining machine 12 should be oriented perpendicular to the panel face 20. In some instances, however, the race 68 may become misaligned with the panel face 20, such as shown in FIG. 3. When this happens, the hydraulic jack 80 is operated in order to return the mining machine 12 to proper face panel alignment.

Currently, it is not easy for a mining machine operator to determine when there is improper face alignment. This disclosure provides a means for the mining machine operator to observe improper face alignment.

More particularly, the mining machine 12 includes alignment means for detecting the relative angular alignment between the mining machine and the roof support 16, which in turn is related to the proper alignment of the mining machine 12 with the panel face 20. The alignment means comprises a light source 90 in the form of a laser on the mining machine 12, directed toward the shield 32. The alignment means also includes a roof support guide 94 on the roof support 16 above the mining machine 12, so that when the alignment between the mining machine 12 and the roof support 16 is as desired, light from the light source 90 falls in a predetermined location relative to the roof support guide 94. The illustrated roof support guide 94 is positioned on an underside of the shield 32. The preferred predetermined location would be on the roof support guide 94, although it could some distance away from the roof support guide 94 in other embodiments (not shown). Also, in less preferred embodiments (not shown), the light source 90 could be directed to a part of the roof support 16 other than on the shield 32.

When the mining machine 12 is not in proper alignment with the roof support 16, the light source 90 will not fall within the predetermined location relative to the roof support guide 94, as shown in FIG. 3. When a mining machine operator detects that the light from the light source 90 is not falling within the predetermined location relative to the roof support guide 94, the operator then adjusts the tilt of the mining machine 12 using the hydraulic jacks 80 to cause the light from the light source 90 to again fall within the predetermined location relative to the roof support guide 94.

In the preferred embodiment, the roof support guide 94, shown schematically in FIGS. 1 through 4, is a colored piece of tape adhered to the shield 32. But in other embodiments, any visible element on the roof support 16 can be used.

Various other features and advantages of the disclosure are apparent from the following claims.

The invention claimed is:

1. A mining installation including:

a mining machine support adapted to be positioned adjacent a mine face on a mine floor, a mining machine adapted to move along the mine face over the mining machine support, a roof support over said mining machine and said mining machine support, means for adjusting the angle of attack of the mining machine relative to the mine face, and means for detecting the relative angular alignment between said mining machine and said roof support, said means comprising a light source on said mining machine directed toward said roof support, a roof support guide on said roof support, so that when said angular alignment between said mining machine and said roof support is as desired, light from said light source falls in a predetermined location relative to said roof support guide.

2. A mining installation in accordance with claim 1 wherein said roof support guide is above said mining machine.

3. A method of operating a mining installation, the mining installation including a mining machine support adapted to be positioned adjacent a mine face on a mine floor, a mining machine adapted to move along the mine face over the mining machine support, a roof support over the mining machine and the mining machine support, means for adjusting the angle of attack of the mining machine relative to the mine face, and means for detecting the relative angular alignment between the mining machine and the roof support, the means including a light source on the mining machine directed toward the roof support, a roof support guide on the roof support, so that when the angular alignment between the mining machine and the roof support is as desired, light from the light source falls in a predetermined location relative to the roof support guide, the method comprising:

the step of detecting that the light from the light source is not falling within a predetermined location relative to the roof support guide; and then the step of adjusting the tilt of the mining machine to cause the light from the light source to again fall within the predetermined location relative to the roof support guide.

4. The mining installation of claim 1, wherein the light source includes a laser.

5. The mining installation of claim 1, wherein the roof support guide includes a strip of tape adhered to the roof support.

6. The mining installation of claim 1, wherein the means for adjusting the angle of attack includes a hydraulic jack.

7. The mining installation of claim 6, wherein the mining support structure includes a skid-type shoe movably supported on a race, the hydraulic jack being coupled to the skid-type shoe.

8. The mining installation of claim 7, wherein extension and retraction of the hydraulic jack causes the mining machine to pitch relative to the mine face.

9. The method of claim 3, wherein the mining installation includes a hydraulic jack, and wherein adjusting the tilt of the mining machine includes operating the hydraulic jack to adjust the tilt of the mining machine.

10. A mining installation comprising:

a mining machine support positioned adjacent a mine face on a mine floor;

a mining machine for movement along the mine face over the mining machine support;

a roof support over the mining machine and the mining machine support;

a light source on the mining machine directed toward the roof support; and a roof support guide on the roof support, angular alignment between the mining machine and the roof support being indicated by a position of light from the light source relative to the roof support guide.

11. The mining installation of claim 10, wherein the light source includes a laser.

12. The mining installation of claim 10, wherein the roof support guide includes a strip of tape adhered to the roof support.

13. The mining installation of claim 10, further comprising a hydraulic jack for adjusting an angle of attack of the mining machine.

14. The mining installation of claim 13, wherein the mining support structure includes a skid-type shoe movably supported on a race, the hydraulic jack being coupled to the skid-type shoe.

15. The mining installation of claim 14, wherein extension and retraction of the hydraulic jack causes the mining machine to pitch relative to the mine face.

* * * * *